US008641043B2

(12) United States Patent
Masuda

(10) Patent No.: US 8,641,043 B2
(45) Date of Patent: Feb. 4, 2014

(54) PAPER FEED UNIT FOR PRINTER

(75) Inventor: Naoya Masuda, Amimachi (JP)

(73) Assignee: Riso Kagaku Corporation, Tokyo (JP)

( * ) Notice: Subject to any disclaimer, the term of this patent is extended or adjusted under 35 U.S.C. 154(b) by 330 days.

(21) Appl. No.: 12/588,158

(22) Filed: Oct. 6, 2009

(65) Prior Publication Data

US 2010/0084806 A1 Apr. 8, 2010

(30) Foreign Application Priority Data

Oct. 8, 2008 (JP) ..... P2008-261905

(51) Int. Cl.
*B65H 5/00* (2006.01)

(52) U.S. Cl.
USPC ..... 271/264; 271/242; 271/243; 271/244; 271/245; 271/10.09; 271/10.11; 271/10.12

(58) Field of Classification Search
USPC ..... 271/242, 10.12, 264, 243–245, 10.09, 271/10.01
See application file for complete search history.

(56) References Cited

U.S. PATENT DOCUMENTS

| | | | | | |
|---|---|---|---|---|---|
| 4,300,756 | A | * | 11/1981 | Danchak et al. | 271/8.1 |
| 4,721,297 | A | * | 1/1988 | Katayama | 271/10.04 |
| 5,022,642 | A | * | 6/1991 | Hasegawa et al. | 271/10.12 |
| 5,358,235 | A | * | 10/1994 | Konno et al. | 271/227 |
| 5,543,909 | A | * | 8/1996 | Quesnel | 399/394 |
| 6,059,279 | A | * | 5/2000 | Wenthe, Jr. | 271/10.13 |
| 6,079,708 | A | * | 6/2000 | Fujita | 271/242 |
| 6,135,447 | A | * | 10/2000 | Lin | 271/229 |
| 6,296,244 | B1 | * | 10/2001 | Hanks et al. | 271/118 |
| 7,484,723 | B2 | * | 2/2009 | Kuo et al. | 271/10.09 |
| 7,835,685 | B2 | * | 11/2010 | Osari et al. | 399/401 |
| 2002/0060389 | A1 | * | 5/2002 | Sugimura | 271/9.11 |
| 2006/0284369 | A1 | * | 12/2006 | Park | 271/242 |
| 2008/0296836 | A1 | * | 12/2008 | Akiyama et al. | 271/242 |
| 2009/0278301 | A1 | * | 11/2009 | Hirai | 271/3.14 |
| 2013/0207340 | A1 | * | 8/2013 | Fukusada | 271/264 |

FOREIGN PATENT DOCUMENTS

| | | | | | |
|---|---|---|---|---|---|
| JP | 63272736 | A | * | 11/1988 | B65H 9/16 |
| JP | 01321234 | A | * | 12/1989 | B65H 5/36 |
| JP | 02249835 | A | | 10/1990 | |
| JP | 05024708 | A | * | 2/1993 | B65H 5/36 |
| JP | 05162878 | A | | 6/1993 | |
| JP | 2004-075275 | | | 3/2004 | |

OTHER PUBLICATIONS

Official Action issued on Nov. 13, 2012, in the counterpart Japanese application JP2008-261905.

* cited by examiner

*Primary Examiner* — Prasad Gokhale
(74) *Attorney, Agent, or Firm* — Nath, Goldberg & Meyer; Jerald L. Meyer; Scott C. Langford

(57) ABSTRACT

A paper feed unit for a printer to form an image on a print paper by an image former, the paper feed unit including: a paper feed tray that stacks print papers to be fed; a paper transfer route that transfers print papers; a register roller that is provided upstream of the image former in a paper transfer direction in the paper transfer route and holds a fed print paper to adjust a timing to transfer the fed print paper to the image former; a pick-up roller that transmits a print paper stacked in the paper feed tray to the register roller, the pick-up roller being smaller in width than a width of a print paper to be transmitted; and a regulator that comes into contact with a loose portion of a print paper loosened in a paper feed route in between the pick-up roller and the register roller.

14 Claims, 8 Drawing Sheets

PAPER FEED UNIT FOR PRINTER

CROSS REFERENCE TO RELATED APPLICATION

This application is based upon and claims the benefit of priority from the prior Japanese Patent Application No. 2008-261905, filed on Oct. 8, 2008, the entire contents of which are incorporated herein by reference.

BACKGROUND OF THE INVENTION

1. Field of the Invention

The present invention relates to a paper feed unit for a printer to form an image on a print paper being transferred in a paper transfer route.

2. Description of the Related Art

Conventionally, when a printer performs printing on a print paper at an image former via a transfer route, a front edge of the print paper is guided to a guide member of a register part to be pushed so that the print paper is loosened. This is because of an adjustment of paper obliqueness, and smooth feeding of the print paper to an image-forming area. Specifically, the print paper is fed into register rollers, which function as a paper adjustment means, and moved slightly further forward with a predetermined amount even after pushing the front edge of the print paper to the register rollers to be paused. Then, the print paper is kept with a loose state in a loose paper receiving space provided upstream of the register part in a paper transfer direction, while the entire front edge of the print paper is aligned with a nipping portion of the register part. Thus, the conventional paper oblique adjustment has been performed.

However, there has been a problem in this method not to be able to adjust paper obliqueness of a current feeding paper properly since a pre-feeding paper highly influences a paper feeding of the current feeding paper.

In order to deal with such a problem, Japanese Patent Laid-Open Publication No. 2004-075275 discloses a guiding member to guide a front edge of a current feeding paper to a paper adjusting means properly, by varying a configuration of a loose paper receiving space between a pre-feeding paper and the current feeding paper by providing a loose paper holding member.

SUMMARY OF THE INVENTION

The object of the above-mentioned related art is to adjust a print paper by loosing the print paper at a register part. However, this method may cause the print paper to get wrinkles in the middle area thereof when the loose paper is kept nipped with rollers of the register part. In this case, a printer executes wrinkle adjustment processing when the wrinkled paper is transferred to an image former from the register part, while making an objectionable noise at the wrinkle elimination. Accordingly, the printer causes a noise every single time in printing.

The present invention has been made in view of the above-described problem, and an object of the present invention is to provide a paper feed unit for a printer capable of preventing a print paper from getting wrinkles at printing, and capable of preventing a noise caused by an adjustment of paper looseness.

To achieve the above-mentioned object, an aspect of the invention is a paper feed unit for a printer to form an image on a print paper by an image former, the paper feed unit comprising: a paper feed tray that stacks print papers to be fed; a paper transfer route that transfers print papers; a register roller that is provided upstream of the image former in a paper transfer direction in the paper transfer route and holds a fed print paper to adjust a timing to transfer the fed print paper to the image former; a pick-up roller that transmits a print paper stacked in the paper feed tray to the register roller, the pick-up roller being smaller in width than a width of a print paper to be transmitted; and a regulator that comes into contact with a loose portion of a print paper loosened in a paper feed route in between the pick-up roller and the register roller.

According to the aspect, the regulator comes into contact with the loose portion of the print paper when the pick-up roller feeds the print paper. This prevents stress from being concentrated on the portion being held by the rotation of the pick-up roller when feeding. Thus, it is possible to prevent the print paper from getting wrinkles when feeding the print paper to the paper transfer route, and reduce noise caused by the adjustment of paper looseness.

The regulator may have a cross-sectional shape formed along a peripheral edge of the pick-up roller in the paper feed route.

According to the above-described configuration, the regulator has the cross-sectional shape formed along the peripheral edge of the pick-up roller. Therefore, the regulator can be provided adjacent to the pick-up roller in order to reduce the size of a casing of the printer and prevent the loose portion of the print paper from contacting with the pick-up roller.

The regulator may cover over the pick-up roller and have a shape of a circular arc, an axis of the circular arc being coincident with a rotating shaft of the pick-up roller.

According to the above-described configuration, the regulator is provided so as to cover over the pick-up roller. Therefore, the regulator can be provided adjacent to the pick-up roller to appropriately protrude toward the portion causing wrinkles. Thus, it is possible to prevent the print paper from being raised just after being fed by the pick-up roller accurately, and reduce the size of the casing of the printer.

The regulator may have a wider width than a width of the pick-up roller in a direction perpendicular to the paper transfer direction.

According to the above-described configuration, the regulator can press a wider area on the print paper being nipped with the pick-up roller than the width of the pick-up roller when stress occurred on the print paper is concentrated around the pick-up roller. Accordingly, it is possible to prevent the print paper from getting wrinkles around the pick-up roller more accurately.

The pick-up roller may transmit a print paper located on a top of print papers stacked in the paper feed tray to the register roller.

According to the above-described configuration, it is possible to obtain the same effects as those of the aspect.

The regulator may come into contact with a portion of a print paper loosened by a rotation force of the pick-up roller in the paper feed route in between the pick-up roller and the register roller, the portion of the print paper on which stress is concentrated in a rotating direction of the pick-up roller.

According to the above-described configuration, it is possible to obtain the same effects as those of the aspect.

The regulator may disperse the stress occurred on the print paper and presses the print paper to regulate a movement of the print paper toward the rotating direction of the pick-up roller.

According to the above-described configuration, it is possible to obtain the same effects as those of the aspect.

BRIEF DESCRIPTION OF THE DRAWINGS

FIG. 8A is a case not including the regulator according to the embodiment of the present invention, and FIG. 8B is a case including the regulator according to the embodiment of the present invention.

DETAILED DESCRIPTION OF THE EMBODIMENT (Overall Configuration of Printer)

Figure 1A:
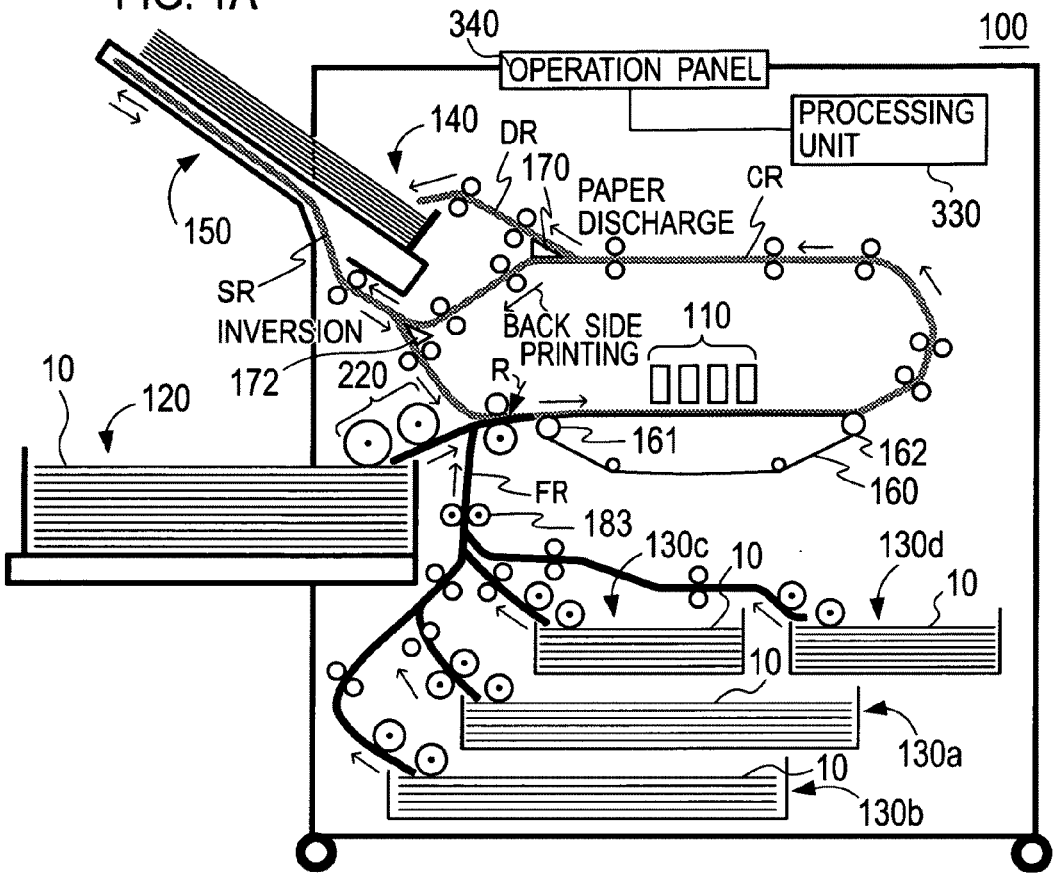
FIG. 1A is a configuration diagram showing a print paper transfer route of a printer according to an embodiment of the present invention.

An embodiment of the present invention will be described with reference to the drawings. FIG. 1A is a configuration diagram showing a print paper transfer route of a printer 100 according to the embodiment of the present invention. The printer 100 of the present embodiment is assumed to be a line color printer of an inkjet type that includes a plurality of ink heads provided with multiple nozzles. The printer 100 performs printing by lines with black or color ink ejecting from each ink head, so as to form an image by overlapping a plurality of frames on a recording paper on a transfer belt.

As shown in FIG. 1A, the printer 100 is an apparatus to form an image on a surface of a print paper transferred in the looped transfer route. The transfer route is generally composed of a system of feed routes FR for feeding a print paper, a common route CR for transferring the print paper fed from the system of feed route FR to a discharge route DR via a head unit 110, and a switchback route SR branched from the common route CR.

The printer 100 has a paper feed unit in the system of feed route FR for feeding a print paper including a side feed table 120 provided at an outside of a side surface of a casing, and a plurality of feed trays 130*a*, 130*b*, 130*c* and 130*d* (hereinafter collectively referred to as "130") provided in the casing. Also, the printer 100 has a paper discharge unit including a discharge port 140 for discharging printed papers.

A print paper is fed from the side feed table 120 or any feed tray 130 of the paper feed unit, and transferred along one route of the system of feed routes FR by drive units such as rollers. Then, the print paper is guided to a register R for positioning a front edge of the fed paper. The print paper is further transferred to the head unit 110, which is provided with a plurality of print heads downstream of the register R in a paper transfer direction, by a transfer belt 160 facing the head unit 110 at a predetermined transfer speed depending on printing conditions. The print paper transferred to the head unit 110 is to have an image formed by ink ejected from respective print heads by lines.

The printed paper is further transferred in the common route CR by the drive units such as rollers. For one-side printing, the print paper is guided directly to the discharge port 140 via the discharge route DR so as to be discharged to stack with a printed side down on a discharge table 150 provided as a print paper receiver of the discharge port 140. The discharge table 150 is formed in a shape of a tray protruding from the casing with a certain thickness. The discharge table 150 is inclined to a lateral wall of the casing. Thus, the print paper discharged from the discharge port 140 is slid down along an inclination of the discharge table 150, and tidily piled up on the discharge table 150 in due course due to a bottom wall provided at a lower portion of the discharge table 150.

For both-side printing, assuming "a front side" as the side to be printed first and "a back side" as the side to be printed next, a print paper printed on the front side is further transferred in the casing without being guided to the discharge route DR. The print paper not guided to the discharge route DR is thus transferred to the switchback route SR by a route select unit 170 provided to select a paper transfer route for back side printing.

The print paper in the switchback route SR received from the common route CR is inverted between the front side and the back side by making the print paper reciprocate in the switchback route SR, which is a so-called switchback. Then, the print paper is re-fed to the common route CR via the route select unit 170, and transferred through the register R to have an image on back side formed in a similar manner to the front side. After back-side printing, the print paper with images on both sides is guided to the discharge port 140 via the discharge route DR so as to be discharged and piled on the discharge table 150 provided as a paper receiver at the discharge port 140.

According to the present embodiment, an internal space of the discharge table 150 is used to perform a switchback for both-side printing. The space in the discharge table 150 is enclosed to keep print papers from being taken from outside during the switchback. Thus, it is possible to prevent the print papers from being pulled out by a user during the switchback. In addition, it is possible to eliminate an extra space for the switchback in the printer 100 due to the internal space of the discharge table 150, which is an inherent member to the printer 100. This prevents the casing from being enlarged in size. The switchback route SR that is separated from the discharge route DR allows for parallel operations between a print paper to be switched back and another paper to be discharged.

In the printer 100, the register R for positioning a front edge of a print paper fed from the system of feed routes FR also receives a print paper having an image on the front side to be re-fed for both-side printing. Thus, there is a junction provided upstream of the register R in the paper transfer direction, where a feed route that is the system of feed routes FR for newly feeding a print paper meets a re-feed route that is the common route CR for circulating a print paper for back-side printing. The register R receives and transfers a print paper adjacent to the junction of the system of feed routes FR and the common route CR.

Figure 1B:
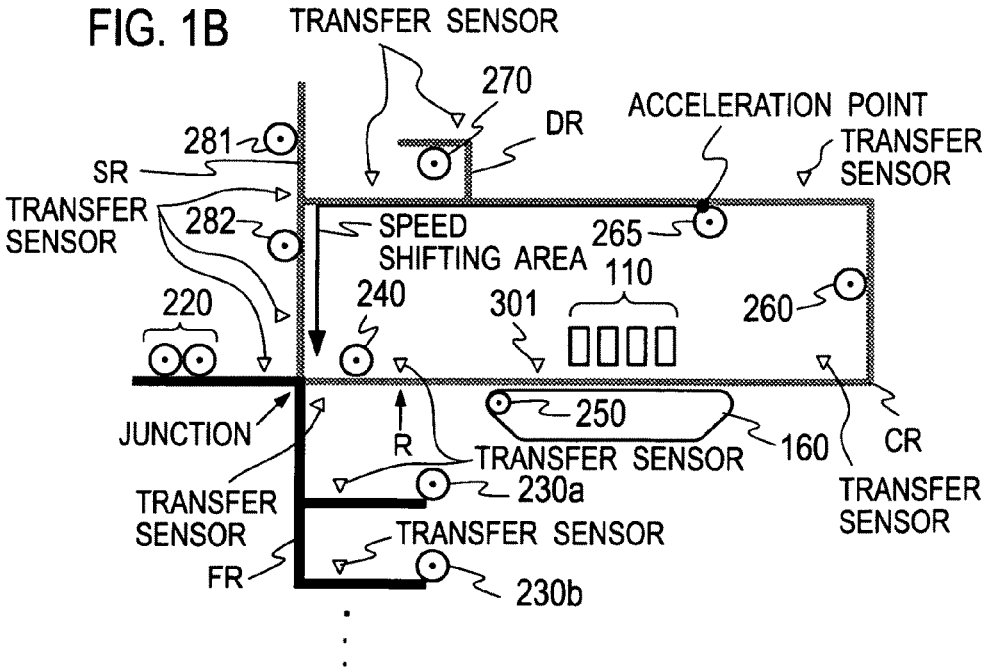
FIG. 1B is a schematic diagram showing a system of feed routes, a common route and a switchback route.

According to the present embodiment, the junction is a reference point to define a section from the paper feed unit to the junction as the system of feed routes FR, and to define the other sections as a paper circulation route collectively. The paper circulation route is looped, and includes the common route CR and the switchback route SR. FIG. 1B is a schematic diagram showing the system of feed routes FR, the common route CR and the switchback route SR. Note that, only main rollers composing the drive units are illustrated in the figure.

The system of feed routes FR includes a side feed drive unit 220 for feeding a print paper from the side feed table 120, and a set of tray drive units 230*a*, 230*b*, . . . (hereinafter collectively referred to as "230") for feeding a print paper from selected one of the feed trays 130. These drive units constitute a paper feed means for feeding a print paper to the register R.

Each drive unit in the system of feed routes FR as mentioned above is composed of a plurality of rollers. The rollers are each operable to feed a print paper one by one from a stack of print papers in the side feed table 120 or any feed tray 130 to transfer to the register R. Each roller is independently controllable depending on feeding conditions of the paper feed unit to feed a print paper.

The system of feed routes FR is provided with a plurality of transfer sensors for detecting transfer jams therein. That is, each transfer sensor detects a presence or absence of a print paper, or a front edge of a print paper. These transfer sensors are provided at certain intervals in the system of feed routes FR. In this case, a transfer jam can be expected when the transfer sensors provided upstream in the paper transfer direction detect a feeding paper, and the transfer sensors provided downstream in the paper transfer direction do not detect the print paper within a predetermined period.

A register sensor, one of the transfer sensors, provided upstream of the register R for transferring a print paper measures a size of a passing paper based on a passing speed and passage time, for instance. In addition, when the register sensor does not detect a feeding paper within a predetermined time after an operation of any drive unit of the side feed drive unit 220 and the tray drive units 230, a transfer jam (feeding error) can be expected.

The common route CR partly and circularly constitutes the paper circulation route, which is from the junction to the junction through the head unit 110 and the discharge route DR. In this case, image-forming processing is executed in the common route CR of the paper circulation route. The common route CR includes a register drive unit 240 for guiding a print paper to the register R, a transfer belt drive unit 250 for circularly activating the transfer belt 160 facing the head unit 110, a first upper transfer drive unit 260 and a second upper transfer drive unit 265 provided in order in the paper transfer direction, a upper discharge drive unit 270 for guiding a printed paper to the discharge port 140, and a drive means for introducing a print paper having an image on the front side to the switchback route SR for back-side printing. Every drive unit is composed of one or a plurality of rollers, which transfer a print paper one by one along the paper circulation route. Each roller is independently controllable depending on paper transferring conditions.

The common route CR is also provided with a plurality of transfer sensors for detecting transfer jams therein. In addition, the register R is configured to be able to confirm whether a print paper is transferred properly. The transfer sensors in the common route CR detect transfer jams in the drive units. Thus, the transfer sensors can specify which drive unit is jammed in the common route CR.

The switchback route SR is branched from the common route CR, and receives a print paper transferred from the common route CR. The switchback route SR, which is a transfer unit, inverts the print paper between the front side and the back side to re-feed to the common route CR by switching back the print paper therein. The switchback route SR includes inverting drive units 281 and 282 for inverting a print paper to guide to the above-mentioned junction. In addition, a print paper can be transferred in the switchback route SR at a different speed from the common route CR. Thus, it is possible to increase and decrease speed when the switchback route SR receives a print paper from the common route CR, or prolong and shorten the time to make a print paper pause at a switchback.

According to the present embodiment, the printer 100 can feed a print paper not only after a previous paper is printed and discharged, but also before the previous paper is discharged so as to perform printing consecutively at certain intervals by scheduling. Therefore, regular scheduling in both-side printing is configured to preliminarily keep specified intervals in order to reserve space to insert a print paper returned from the switchback route SR when newly feeding a print paper. This permits the printer 100 to perform front-side printing and back-side printing in parallel, which achieves a print productivity in half the time it takes in one-side printing.

The transfer belt 160 is hitched to a drive roller 161 and a driven roller 162 provided upstream and downstream in the transfer direction at both end portions of the transfer belt 160 facing the head unit 110. The transfer belt 160 circularly runs on the both rollers in a clockwise direction in FIG. 1A. The head unit 110 includes an array of four-color ink heads along the transfer direction facing the upper side of the transfer belt 160. The head unit 110 forms an image in color by overlapping a plurality of frames by ejecting ink from the ink heads.

As shown in FIG. 1A, the printer 100 includes a processing unit 330. The processing unit 330 is a processing module that is composed of hardware such as a processor including CPU and DSP (Digital Signal Processor), memory and other electronic circuits, software such as a program including the above-mentioned functions, or a combination of those. The processing unit 330 virtually assembles a variety of functional modules by appropriately reading and executing programs, and executes image data processing, control processing of each component performance, and a variety of processing for user operations. In addition, the processing unit 330 is connected to an operation panel 340 to accept user commands and setting operations via the operation panel 340.

(Paper Feed Unit)

Figure 2:
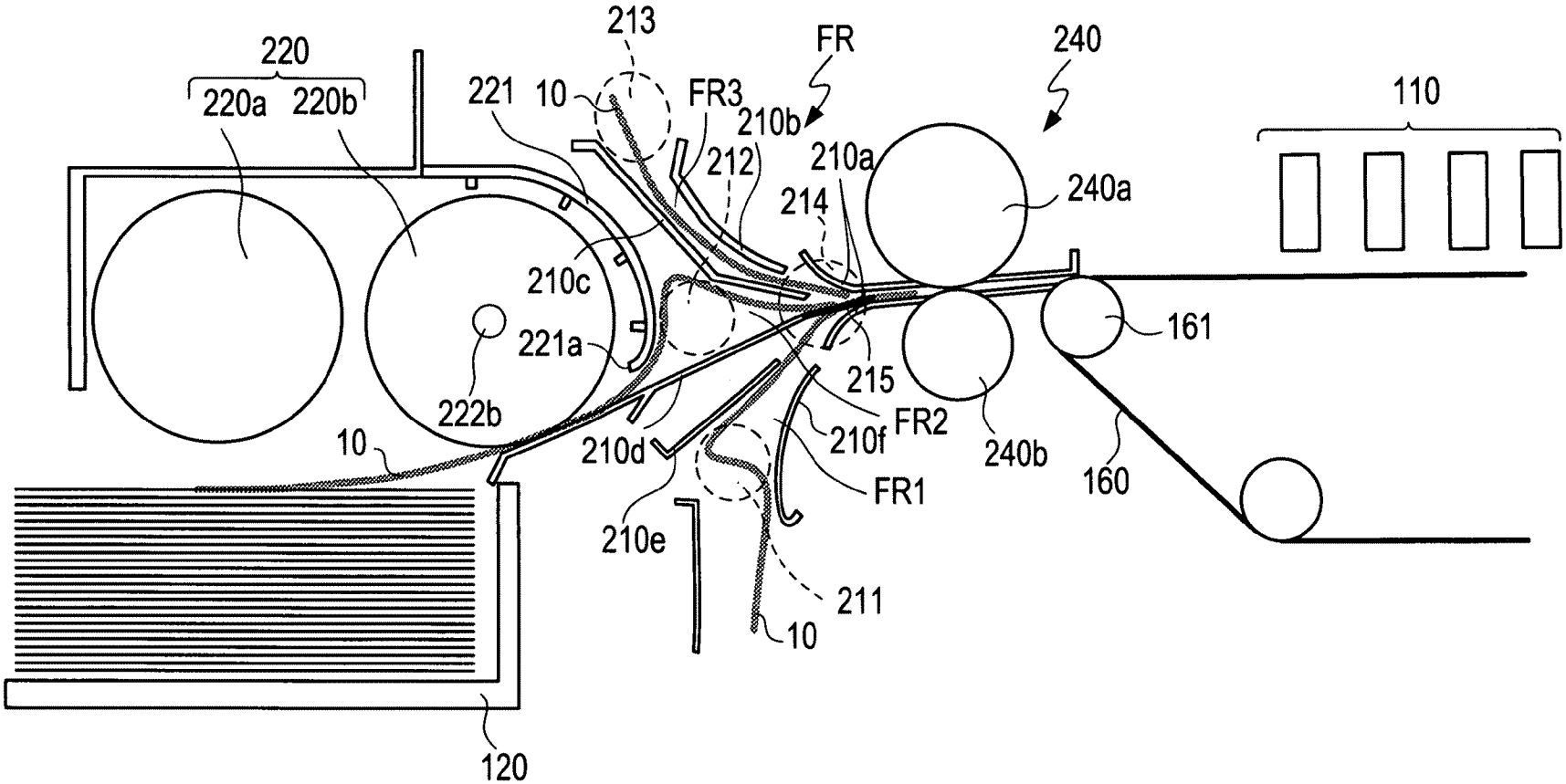
FIG. 2 is a side view showing a schematic configuration of a paper feed unit according to an embodiment of the present invention.

The system of feed routes FR includes the paper feed unit according to the present embodiment of the present invention. FIG. 2 is a side view showing a schematic configuration of the paper feed unit according to the embodiment.

As shown in the figure, the paper feed unit is provided in the system of feed routes FR for feeding a print paper to the register R. According to the present embodiment, the paper feed unit includes a paper feed route FR1 for newly feeding a print paper from any one of the feed trays 130 provided at the lower part in the apparatus body, a paper feed route FR2 for newly feeding a print paper from the side feed table 120, and a paper feed route FR3 for re-feeding a print paper from the switchback route SR. These paper feed routes meet at a meeting area 214, through which a print paper from any one of the paper feed routes FR1, FR2 and FR3 is fed to the register R.

In the register R, the register drive unit 240 is provided upstream of the head unit 110 in the paper transfer direction in the common route CR. A pair of register rollers 240*a* and 240*b*, which composes the register drive unit 240, temporarily hold a print paper fed from the system of feed routes FR to the common route CR to control a transfer timing of the print paper to the head unit 110. In addition, respective confluences of the paper feed routes FR1, FR2 and FR3 are provided upstream of the register rollers 240*a* and 240*b*. Thus, a print paper from any of the paper feed routes FR1, FR2 and FR3 is guided to the meeting area 214 via respective confluences.

The meeting area 214 is provided with a pair of upper and lower guide members 210*a* configured to form a meeting route sandwiched therebetween tapering toward the register R provided downstream of the meeting area 214. The paper feed routes FR1, FR2 and FR3 are sectioned by guide members 210*a* to 210*f* (hereinafter collectively referred to as "210"), and collectively guided to the meeting area 214. Each paper feed route composed of the guide members 210 is gradually widened in the opposite direction of the paper transfer direction. Thus, the paper feed routes FR1, FR2 and FR3 are provided with widened areas 211, 212 and 213, respectively, due to the guide members 210.

Specifically, the paper feed route FR1 is formed by being sandwiched between the guide members 210*e* and 210*f* tapering toward the meeting area 214 to feed a print paper upwardly. The paper feed route FR1 is provided with the widened area 211 formed by the guide members 210*e* and 210*f* being gradually widened downwardly. The widened area 211 is provided with paper feed rollers 183 at a lower part thereof (refer to FIG. 1A). A front edge of a print paper fed upwardly by the paper feed rollers 183 comes into contact with the register rollers 240*a* and 240*b*, so that the print paper is loosened in the widened area 211.

The paper feed route FR2 is formed by being sandwiched between the guide members 210*c* and 210*d* tapering toward the meeting area 214 to feed a print paper diagonally upward. The paper feed route FR2 is provided with the widened area 212 formed by the guide members 210*d* and 210*c* being gradually widened in the opposite direction of the paper transfer direction. The widened area 212 is provided with the side feed drive unit 220 upstream thereof. A front edge of a print paper fed downstream by a pick-up of the side feed drive unit 220 comes into contact with the register rollers 240*a* and 240*b*, so that the print paper is loosened in the widened area 212.

The paper feed route FR3 is formed by being sandwiched between the guide members 210*b* and 210*c* tapering toward the meeting area 214 to transfer a print paper diagonally downward. The paper feed route FR3 is provided with the widened area 213 formed by the guide members 210*b* and 210*c* being gradually widened diagonally upward. The widened area 213 is provided with a drive unit of the switchback route SR (e.g. inverting drive unit 282) at an upper part thereof. A front edge of a print paper re-fed downwardly by the drive unit comes into contact with the register rollers 240*a* and 240*b*, so that the print paper is loosened in the widened area 213.

Figure 3:
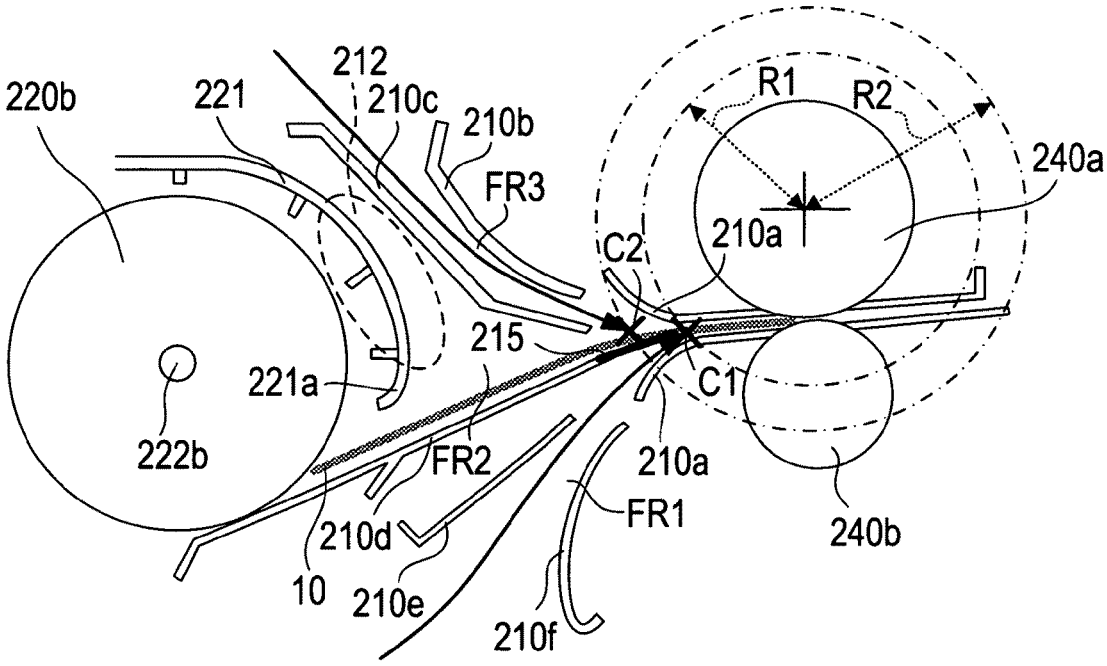
FIG. 3 is an explanatory view showing an operation of a paper feed unit according to an embodiment of the present invention.

According to the present embodiment, a guide member 215 to control paper feeding in the paper feed routes FR1, FR2 and FR3 is provided so that respective confluences C1 and C2 (refer to FIG. 3) of the paper feed routes FR1, FR2 and FR3 located upstream of the meeting area 214 do not correspond with each other. Specifically, the guide member 215 is a sheet member made of soft resin such as plastic and acrylic. The guide member 215 is provided as an extension of the front edge of the guide member 210*d* sectioning the paper feed routes FR1 and FR2. Thus, the confluence C1 of the paper feed routes FR1 and FR2 is to be located at the most downstream portion in the meeting area. As shown in FIG. 3, the guide member 215 is protruded to block the paper feed route FR1 and insulate the downstream confluence C1 from the upstream confluence C2. Then, a print paper pushes up the guide member 215 to join the paper feed route FR2 when the print paper in the paper feed route FR1 hits the guide member 215 in front of the confluence C1. Thus, the confluence C1 is shifted downstream due to the guide member 215 so as to prevent the confluence C1 from corresponding to the confluence C2 of the paper feed routes FR2 and FR3.

Due to such a positional gap of the confluences by the guide member 215, the respective confluences C1 and C2 of the paper feed routes FR1, FR2 and FR3 are to be on concentric circles with two different radii R1 and R2 around a rotation axis of the register roller 240*a*. This makes the confluences C1 and C2 different in a distance from the register roller 240*a*. Thus, flow lines of print papers from each paper feed route to the register rollers 240*a* and 240*b* do not correspond with each other in such a narrow area (meeting area 214) in front of the register rollers 240*a* and 240*b*.

Figure 4A:
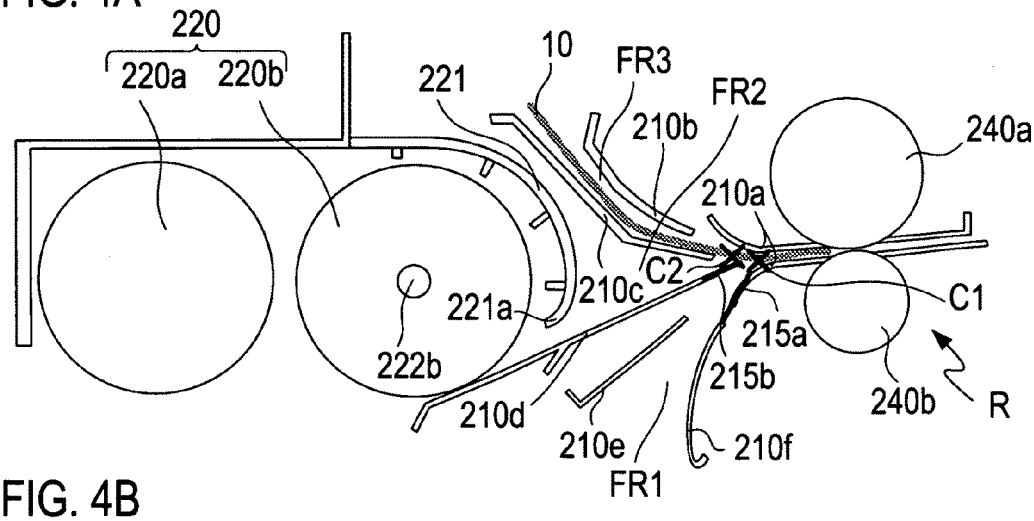
FIGS. 4A to 4C are side views showing modified examples of guide members of a paper feed unit.
Figure 4B:
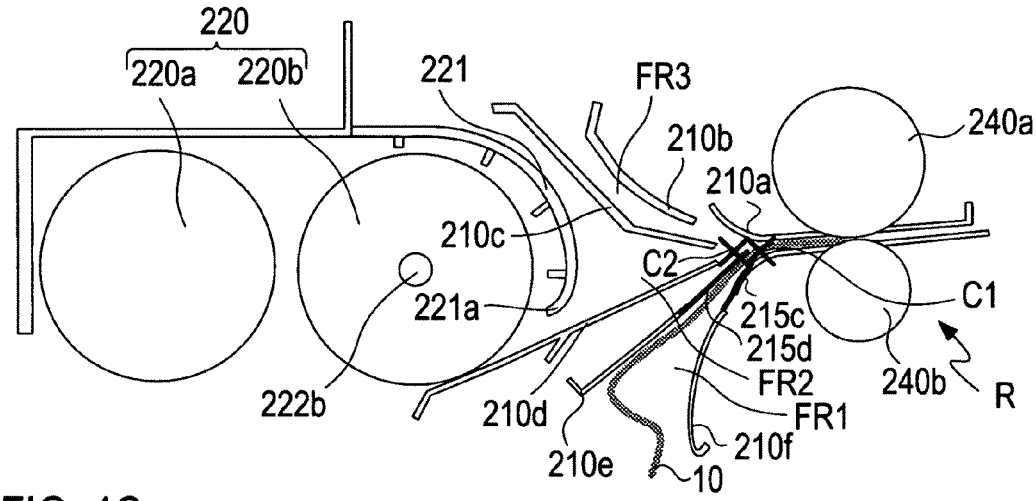
Figure 4C:
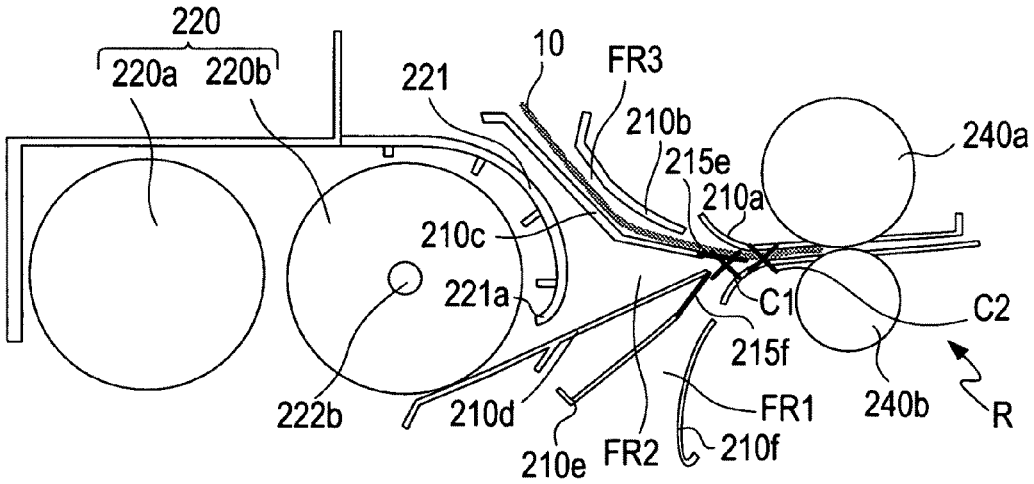

According to the present embodiment, the guide members 210 are configured to be sheet members provided among the paper feed routes. While, the following modifications can be possible. FIGS. 4A to 4C are explanatory views showing modified examples of the guide members.

For instance, as shown in FIG. 4A, the guide member 215 is composed of two or more members provided as extensions of the front edges of the guide members 210 sectioning the paper feed routes FR1, FR2 and FR3. These guide members are plate-like members, which are made of a thin metal sheet, flexible resin, and the like.

Specifically, as one of the guide members, an introduction member 215*b* is provided upstream of the confluence C1 of the paper feed routes FR1 and FR2 so as to insulate the confluence C1 from the confluence C2 of the paper feed routes FR2 and FR3, and block a print paper in the paper feed route FR1 to be fed to the confluence C1. As another one of the guide members, provided is a contact member 215*a* that comes into contact with a loose part of a print paper at a side of the print paper opposite to a side of the print paper facing the confluence C2 in the paper feed route FR1. In this example, the introduction member 215*b* prevents the print paper in the paper feed route FR1 from being brought toward the confluence C2 due to the insulation. In addition, it is possible to avoid unnecessary looseness of the print paper in the meeting area 214 due to the contact member 215*a* coming into contact with the loose part of the print paper at the side of the print paper opposite to the side of the print paper facing the confluence C2 in the paper feed route FR1. Moreover, since a front edge of the print paper in the paper feed route FR1 hits the introduction member 215*b*, the print paper is to be guided to the register drive unit 240.

As another modified example of the guide members, as shown in FIG. 4B, an introduction member 215*d* and a contact member 215*c* are available. The introduction member 215*d* is provided upstream of the confluence C1 of the paper feed routes FR1 and FR2 so as to insulate the confluence C1 from the confluence C2 of the paper feed routes FR2 and FR3, and block a print paper in the paper feed route FR1 to be fed to the confluence C1. The contact member 215*c* is provided that comes into contact with a loose part of a print paper at a side of the print paper opposite to a side of the print paper facing the confluence C2 in the paper feed route FR1.

As yet another modified example of the guide members, as shown in FIG. 4C, an introduction member 215*e* and a contact member 215*f* are available. The introduction member 215*e* is provided upstream of the confluence C2 of the paper feed routes FR2 and FR3 so as to insulate the confluence C2 from the confluence C1 of the paper feed routes FR1 and FR2, and block a print paper in the paper feed route FR3 to be fed to the confluence C2. The contact member 215*f* is provided that comes into contact with a loose part of a printing paper at a side of the printing paper facing the confluence C1 in the paper feed routes FR1.

Figure 5A:
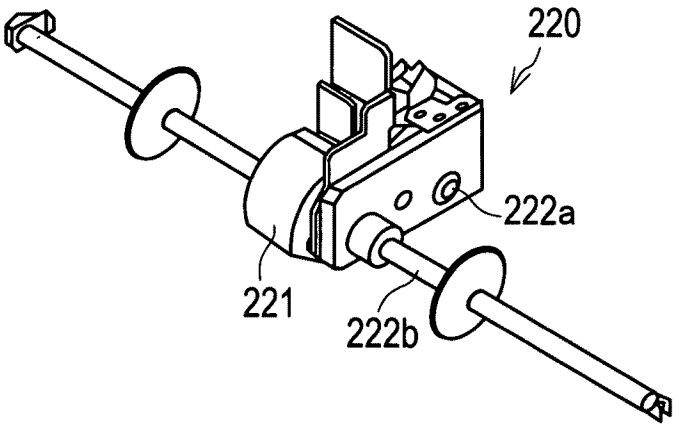
FIGS. 5A and 5B are perspective views showing a configuration of a side paper feed drive unit and a regulator according to an embodiment of the present invention.
Figure 5B:
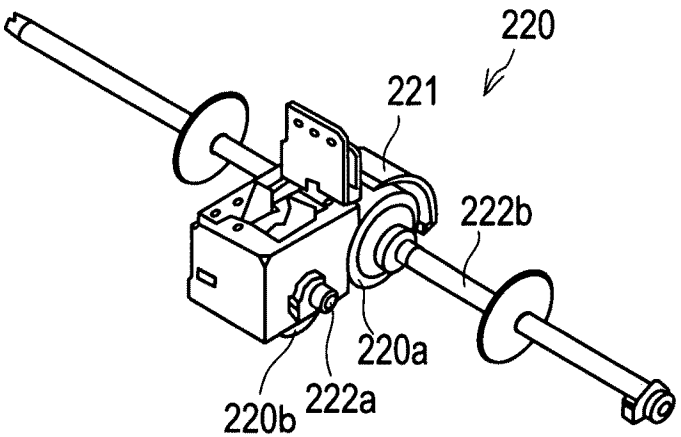
Figure 5C:
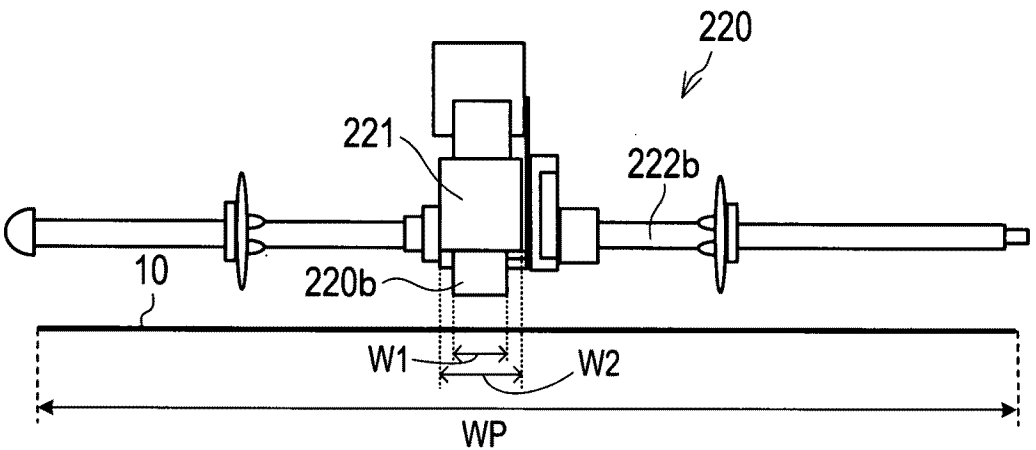
FIG. 5C is a front view showing the configuration of the side paper feed drive unit and the regulator according to the embodiment of the present invention.

In the paper feed route FR2, the side feed table 120 is provided with the side feed drive unit 220 to feed a print paper one by one from stacked print papers stacked and stored in the side feed table 120. The side feed drive unit 220 is composed of a pick-up roller 220*a* provided on an upstream side and a pick-up roller 220*b* provided on a downstream side. As shown in FIGS. 5A to 5C, the pick-up rollers 220*a* and 220*b* are supported on rotating shafts 222*a* and 222*b*, respectively. The pick-up roller 220*b* is activated by a torque driven by the rotating shaft 222*a*. The pick-up rollers 220*a* and 220*b*, which pick up a print paper from the top of the stacked print papers in the side feed table 120 and feed to the register R, have rollers smaller in width than a width WP of a print paper 10. Note that, the print paper from the side feed table 120 is not limited to the one picked up from the top of the stacked papers. The pick-up rollers 220*a* and 220*b* may pick up a print paper located at the middle or the bottom of the stacked papers, by being modified a configuration of the side feed table 120 and the side feed drive unit 220.

Figure 6:
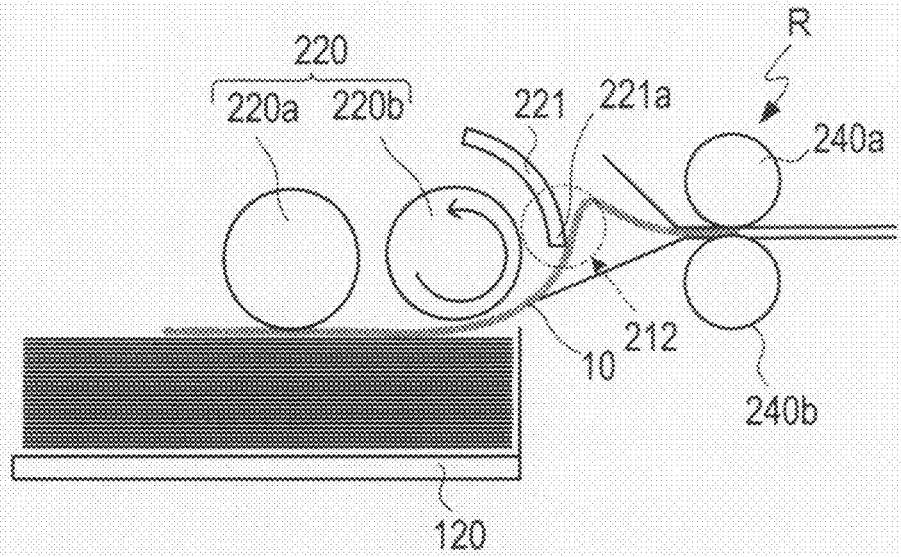
FIG. 6 is a schematic diagram showing a configuration of a regulator according to an embodiment of the present invention.

In addition, a regulator 221 is provided in the paper feed route FR2 between the side feed drive unit 220 and the register drive unit 240, so that the regulator 221 pushes a loose portion of a print paper when the print paper is loosened in the widened area 212 in the paper feed route FR2. As shown in FIG. 5C, the regulator 221 has a width W2 perpendicular to the paper transfer direction and wider than a width W1 of the pick-up roller 220*b* perpendicular to the paper transfer direction. Moreover, as shown in FIG. 6, the regulator 221 has a cross-sectional shape formed along a peripheral edge of the pick-up roller 220*b*. The regulator 221 has a shape of a circular arc, of which axis is the rotating shaft 222*b* of the pick-up roller 220*b*, protruding toward an opposite direction of a rotating direction of the pick-up roller 220*b* (direction of arrow in FIG. 6). The regulator 221 has a front edge 221 a having a larger curvature on a paper feeding side and bending toward an inner diameter of the circular arc (pick-up roller side). Thus, the front edge 221*a* of the regulator 221 is to moderately push the loose portion of the print paper.

Figure 7A:
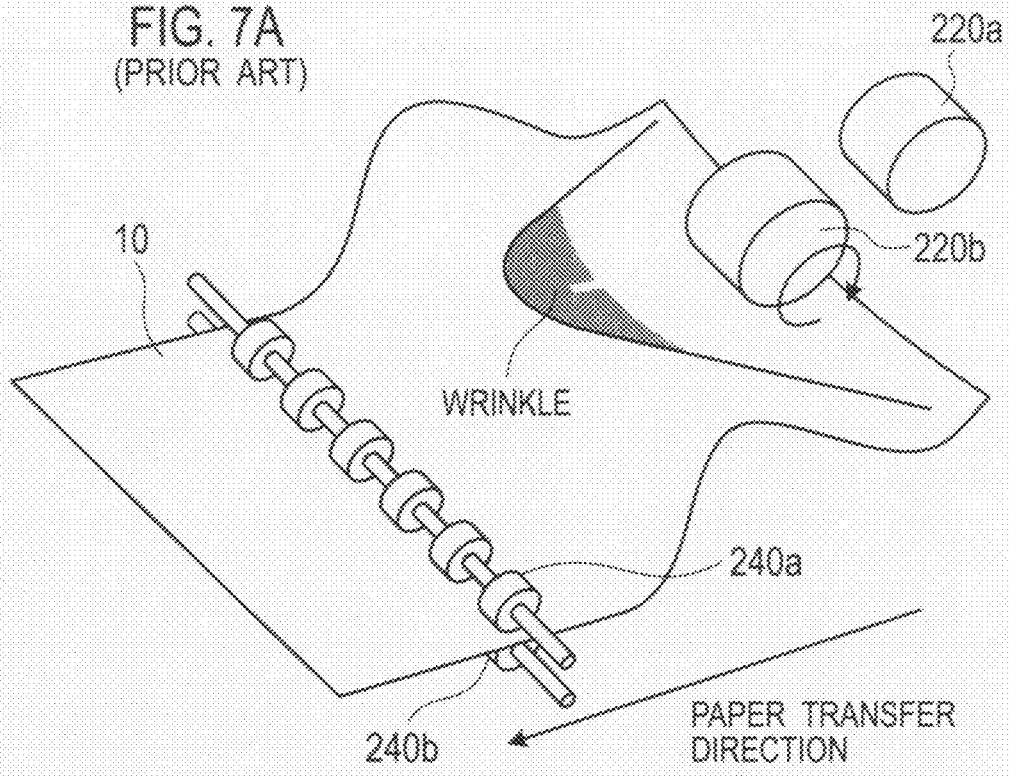
FIG. 7A (PRIOR ART)
FIG. 7A is an explanatory view showing a print paper with wrinkles occurred in a conventional printer.
Figure 7B:
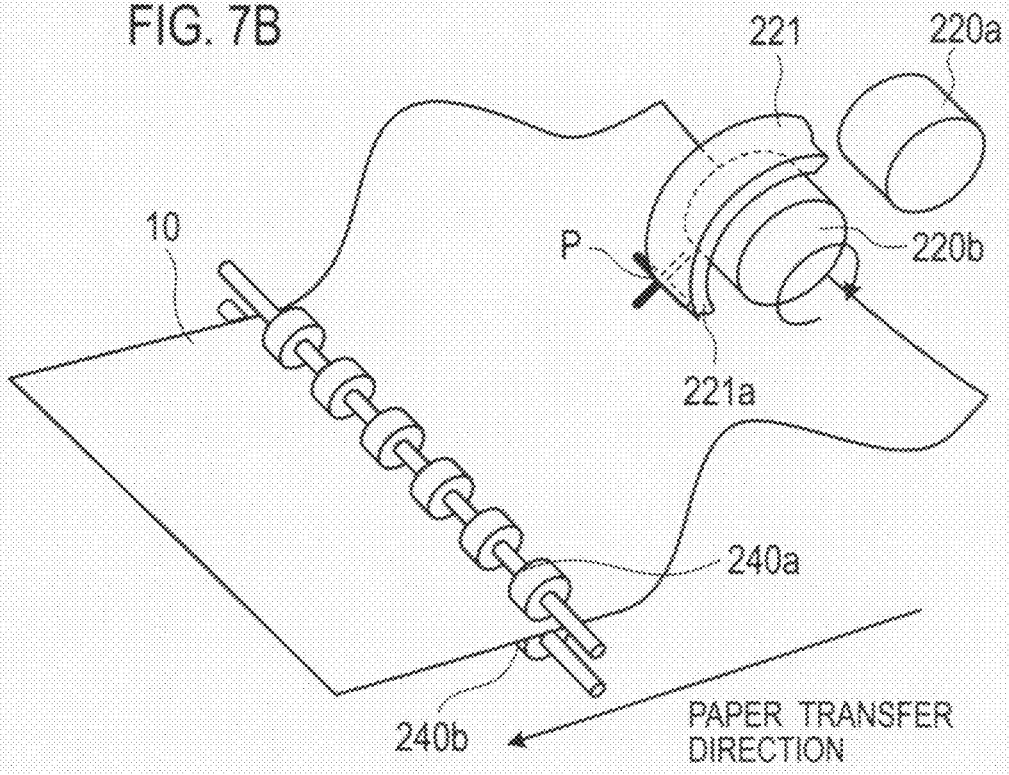
FIG. 7B is an explanatory view showing a contact portion of a print paper with a regulator of a printer according to an embodiment of the present invention.

In the present embodiment, due to the presence of the regulator 221 protruding into the widened area 212, a portion P shown in FIG. 7B on the print paper 10 transferred in the paper transfer direction (indicated by an arrow in FIG. 7B) is pressed to limit a movement of the print paper 10 in a direction to be loosened (approximately upper direction in FIG. 7B and rotating direction of pick-up roller 220*b*). Due to the regulator 221 protruding in the opposite rotating direction of the pick-up roller 220*b*. the regulator 221 is arranged so as to come into contact with a portion of a print paper 10 on which a stress is concentrated in a rotating direction of the pick-up roller 220*b* when the print paper 10 is transferred to the register R being loosened by a rotation force of the pick-up roller 220*b*, whereby dispersing the concentrated stress on the print paper 10 and regulating the movement of the print paper 10 in a direction to be loosened. Thus, the regulator 221 can prevent the print paper 10 from getting wrinkles caused by the rotation of the pick-up roller 220*b*. While, since the conventional printer does not include the regulator 221 according to the embodiment of the present invention, it causes a print paper 10 to get wrinkles as shown in FIG. 7A. Here, the term "wrinkles" is used to indicate the shape shown in FIG. 7A.

The regulator 221 according to the present embodiment has the cross-sectional shape of the circular arc covering over the pick-up roller 220*b* as described above. However, the regulator 221 may have any shape protruding toward an area on a print paper where wrinkles may be formed. For instance, a rod member to push down on the portion P to cause wrinkles, or a shaft member crossing over a print paper in a transverse direction to be parallel to the rotating shaft 222*b* may be applicable.

(Operational Effect)

According to the above-described embodiment, the guide member 215 is provided in order that the respective confluences C1 and C2 of the paper feed routes FR1, FR2 and FR3 do not correspond with each other. This prevents extra space to cause unnecessary looseness of a print paper from being present around the confluences C1 and C2, caused by correspondence of the confluence C1 with the confluence C2. In addition, since the widened areas 211 to 213 are provided to allow for paper looseness, a print paper can be loosened in an appropriate position in respective paper feed routes FR1 to FR3. Therefore, it is possible to prevent the print paper 10 from being loosened unnecessarily around the meeting area 214 where print papers assembles and intersects one another, and also reduce noise caused by the adjustment of paper looseness.

Moreover, according to the present embodiment, the regulator 221 pushes the loose portion of the print paper 10 when the print paper 10 is fed by the pick-up roller 220*b*. This prevents stress from being concentrated on the portion being held by the rotation of the pick-up roller 220*b* when feeding. Thus, it is possible to prevent the print paper 10 from getting wrinkles and reduce noise caused by the adjustment of paper looseness.

Figure 8A:
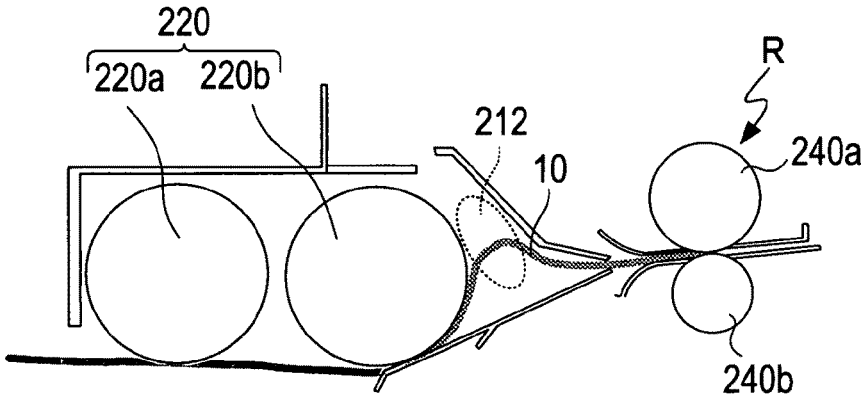
FIG. 8A (PRIOR ART)
FIGS. 8A and 8B are explanatory views showing a presence or absence of wrinkles due to a presence or absence of a regulator according to an embodiment of the present invention.
Figure 8B:
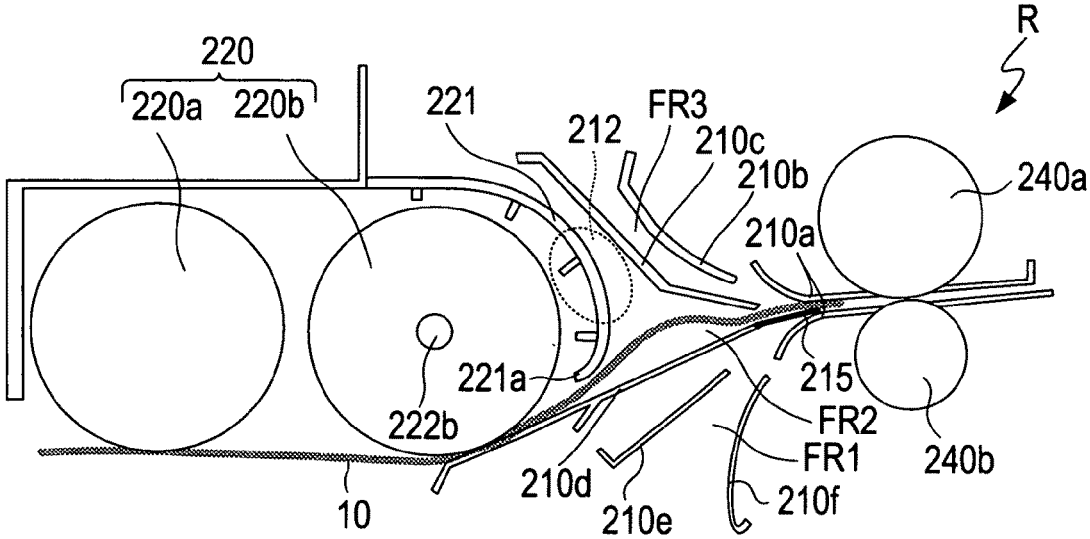

Specifically, as shown in FIG. 8A, when the regulator 221 is not provided in the printer, the print paper 10 gets wrinkles in the middle area thereof while the print paper 10 is nipped (held) with the pick-up roller 220*b* in the widened area 212. According to the present embodiment, as shown in FIG. 8B, the regulator 221 is provided covering over the peripheral edge of the pick-up roller 220*b* and protruding toward the portion P to cause wrinkles. Therefore, it is possible that the print paper 10 is loosened appropriately in the widened area 212 while preventing the print paper 10 from getting wrinkles.

The regulator 221 has a cross-sectional shape formed along the peripheral edge of the pick-up roller 220*b* and covering over the pick-up roller 220*b*, and has a shape of a circular arc of which axis is the rotating shaft of the pick-up roller 220*b*. Therefore, the regulator 221 can be provided adjacent to the pick-up roller 220*b* to prevent the print paper 10 from being partly raised just after being fed by the pick-up roller 220*b* and reduce the size of the casing of the printer. Also, the regulator 221 can prevent the loose portion of the print paper 10 from coming into contact with the pick-up roller 220*b*.

Furthermore, as shown in FIG. 5C, the regulator 221 has the width W2 perpendicular to the paper transfer direction and wider than the width W1 of the pick-up roller 220*b* perpendicular to the paper transfer direction. Therefore, the regulator 221 can press a wider area on the print paper 10 than the width W2 of the pick-up roller 220*b* when stress on the print paper 10 is concentrated around the pick-up roller 220*b* by being nipped with the pick-up roller 220*b*. Accordingly, it is possible to prevent the print paper 10 from getting wrinkles around the pick-up roller 220*b* more accurately.

According to the present embodiment, the regulator 221 protrudes toward the opposite rotating direction of the pick-up roller 220*b*. Therefore, the protrusion of the regulator 221 can press the portion on which stress is concentrated in the rotating direction. Thus, it is possible to prevent the print paper 10 from getting wrinkles when being nipped with the pick-up roller 220*b*, and reduce noise caused by the adjustment of paper looseness, by pressing the portion P to cause wrinkles and keeping the print paper 10 from moving toward the loosening direction.

A paper feed unit for a printer according to the embodiment of the present invention has been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiment of the present invention are only a list of optimum effects achieved by the present invention. Hence, the effects of the present invention are not limited to those described in the embodiment of the present invention.

What is claimed is:

1. A paper feed unit for a printer to form an image on a print paper by an image former, the paper feed unit comprising:

a paper feed tray that stacks print papers to be fed;

a paper transfer route that transfers print papers;

a register roller that is provided upstream of the image former in a paper transfer direction in the paper transfer route and holds a fed print paper to adjust a timing to transfer the fed print paper to the image former;

a pick-up roller that transmits a print paper stacked in the paper feed tray directly to the register roller without intervening rollers, the pick-up roller being smaller in width than a width of a print paper transmittable in the paper feed unit; and a regulator having a front edge configured to come into contact with a loose portion of a print paper loosened in a paper feed route in between the pick-up roller and the register roller, wherein the regulator includes a surface that is extended circumferentially along a rolling surface of the pick-up roller, and wherein the front edge bends towards the rolling surface of the pick-up roller.

2. The paper feed unit for a printer according to claim 1, wherein the regulator covers over the pick-up roller and has a shape of a circular arc at a downstream side of the pick-up roller, an axis of the circular arc being coincident with a rotating shaft of the pick-up roller.

3. The paper feed unit for a print according to claim 1, wherein the regulator has a wider width than a width of the pick-up roller in a direction perpendicular to the paper transfer direction.

4. The paper feed unit for a printer according to claim 1, wherein the pick-up roller transmits a print paper located on a top of print papers stacked in the paper feed tray to the register roller.

5. The paper feed unit for a printer according to claim 1, wherein the front edge comes into contact with a portion of a print paper loosened by a rotation force of the pick-up roller in the paper feed route in between the pick-up roller and the register roller, the portion of the print paper on which stress is concentrated in a rotating direction of the pick-up roller.

6. The paper feed unit for a printer according to claim 5, wherein the front edge disperses the stress occurred on the print paper and presses the print paper to regulate a movement of the print paper toward the rotating direction of the pick-up roller.

7. The paper feed unit for a printer according to claim 1, wherein the pick-up roller is configured to loosen the print paper in the paper feed route by a rotation force of the pick-up roller, and the front edge is configured to come into contact with a portion of the print paper as loosened in the paper feed route, the portion of the print paper on which stress is concentrated in a rotating direction of the pick-up roller, to disperse the stress occurred on the print paper and press the print paper to regulate a movement of the print paper toward the rotating direction of the pick-up roller, to prevent the print paper from getting wrinkles.

8. A paper feed unit for a printer to form an image on a print paper by an image former, the paper feed unit comprising:

a paper feed tray that stacks print papers to be fed;

a paper transfer route that transfers print papers;

a register roller that is provided upstream of the image former in a paper transfer direction in the paper transfer route and holds a fed print paper to adjust a timing to transfer the fed print paper to the image former;

a pick-up roller that transmits a print paper stacked in the paper feed tray to the register roller, the pick-up roller being smaller in width than a width of a print paper to be transmitted; and a regulator having a front edge configured to come into contact with a loose portion of a print paper loosened in a paper feed route in between the pick-up roller and the register roller, wherein the regulator includes a surface that is extended circumferentially along a rolling surface of the pick-up roller, and wherein the regulator has a width:

wider than the width of the pick-up roller in a direction perpendicular to the paper transfer direction, and narrower than the width of the register roller.

9. The paper feed unit for a printer according to claim 8, wherein the regulator covers over the pick-up roller and has a shape of a circular arc at a downstream side of the pick-up roller, an axis of the circular arc being coincident with a rotating shaft of the pick-up roller.

10. The paper feed unit for a printer according to claim 8, wherein the pick-up roller transmits a print paper located on a top of print papers stacked in the paper feed tray to the register roller.

11. The paper feed unit for a printer according to claim 8, wherein the front edge comes into contact with a portion of a print paper loosened by a rotation force of the pick-up roller in the paper feed route in between the pick-up roller and the register roller, the portion of the print paper on which stress is concentrated in a rotating direction of the pick-up roller.

12. The paper feed unit for a printer according to claim 11, wherein the front edge disperses the stress occurred on the print paper and presses the print paper to regulate a movement of the print paper toward the rotating direction of the pick-up roller.

13. The paper feed unit for a printer according to claim 8, wherein the pick-up roller is configured to loosen the print paper in the paper feed route by a rotation force of the pick-up roller, and the front edge is configured to come into contact with a portion of the print paper as loosened in the paper feed route, the portion of the print paper on which stress is concentrated in a rotating direction of the pick-up roller, to disperse the stress occurred on the print paper and press the print paper to regulate a movement of the print paper toward the rotating direction of the pick-up roller, to prevent the print paper from getting wrinkles.

14. The paper feed unit for a printer according to claim 8, wherein the front edge bends towards the rolling surface of the pick-up roller.

* * * * *